US008398359B2

(12) United States Patent
Gallier et al.

(10) Patent No.: US 8,398,359 B2
(45) Date of Patent: Mar. 19, 2013

(54) EXHAUST DIFFUSER

(75) Inventors: Kirk Douglas Gallier, Greenville, SC (US); Sudhakar Neeli, Karnataka (IN)

(73) Assignee: General Electric Company, Schenectady, NY (US)

( * ) Notice: Subject to any disclaimer, the term of this patent is extended or adjusted under 35 U.S.C. 154(b) by 524 days.

(21) Appl. No.: 12/706,746

(22) Filed: Feb. 17, 2010

(65) Prior Publication Data

US 2011/0200421 A1 Aug. 18, 2011

(51) Int. Cl.
*F01D 25/30* (2006.01)

(52) U.S. Cl. ..... 415/1; 415/101; 415/224.5

(58) Field of Classification Search ..... 415/93, 415/101, 207, 212.1, 224.5, 1
See application file for complete search history.

(56) References Cited

U.S. PATENT DOCUMENTS

| | | | | |
|---|---|---|---|---|
| 1,269,998 | A * | 6/1918 | Baumann | 60/697 |
| 3,837,760 | A * | 9/1974 | Stalker | 415/181 |
| 4,212,452 | A * | 7/1980 | Hsieh | 266/156 |
| 5,174,120 | A * | 12/1992 | Silvestri, Jr. | 60/692 |
| 5,494,405 | A | 2/1996 | Gray et al. | |
| 5,518,366 | A | 5/1996 | Gray | |
| 5,984,628 | A | 11/1999 | Gray et al. | |
| 6,261,055 | B1 | 7/2001 | Owczarek | |
| 6,419,448 | B1 * | 7/2002 | Owczarek | 415/207 |
| 2006/0222489 | A1 * | 10/2006 | Mizumi et al. | 415/191 |
| 2009/0246010 | A1 * | 10/2009 | Roach | 415/207 |
| 2009/0263241 | A1 * | 10/2009 | Demiraydin et al. | 415/207 |
| 2011/0158799 | A1 * | 6/2011 | Dalsania et al. | 415/211.2 |

FOREIGN PATENT DOCUMENTS

| | | | |
|---|---|---|---|
| FR | 2569766 | * | 3/1986 |
| JP | 2000-45709 | * | 2/2000 |

OTHER PUBLICATIONS

Ryzhkov et al., Steam Turbine Low-Pressure Cylinder, Mar. 7, 1986, Abstract of FR2569766.*
Masuzawa et al., Exhaust Hood for Low-Pressure Steam Turbine, Feb. 15, 2000, Abstract of JP2000-45709.*

* cited by examiner

*Primary Examiner* — Edward Look
*Assistant Examiner* — Liam McDowell
(74) *Attorney, Agent, or Firm* — Cantor Colburn LLP

(57) ABSTRACT

An exhaust diffuser including an outer flow guide surface and an inner flow guide surface defining an inlet, a first collection chute having an outlet in fluid communication with the inlet, the first collection chute operative to diffuse a flow of a fluid, a second collection chute having an outlet in fluid communication with the inlet, the second collection chute operative to diffuse the flow of the fluid, and the outer flow guide surface and the inner flow guide surface are operative to guide and direct the flow of the fluid to the first collection chute and the second collection chute.

16 Claims, 12 Drawing Sheets

EXHAUST DIFFUSER

BACKGROUND OF THE INVENTION

The subject matter disclosed herein relates to steam turbines and particularly to exhaust diffusers. Exhaust diffusers receive steam as the steam exits the turbine, and output the steam at a reduced velocity to an exhaust housing. The reduction in velocity of the steam reduces back pressure on the turbine blades and increases the efficiency of the system.

BRIEF DESCRIPTION OF THE INVENTION

According to one aspect of the invention, an exhaust diffuser includes an inlet defined by an outer flow guide surface and an inner flow guide surface operative to receive a fluid, a first collection chute having an increasing flow area operative to diffuse the flow of a fluid and an outlet in fluid communication with the inlet, and a second collection chute having an increasing flow area operative to diffuse the flow of the fluid and an outlet in fluid communication with the inlet, the outer flow guide surface and the inner flow guide surface are operative to guide and direct the flow of the fluid to the first collection chute and the second collection chute along curved flow paths.

According to another aspect of the invention, an exhaust diffuser includes an outer flow guide surface and an inner flow guide surface defining an inlet, a first collection chute having an outlet in fluid communication with the inlet, the first collection chute operative to diffuse a flow of a fluid, a second collection chute having an outlet in fluid communication with the inlet, the second collection chute operative to diffuse the flow of the fluid, and the outer flow guide surface and the inner flow guide surface are operative to guide and direct the flow of the fluid to the first collection chute and the second collection chute.

According to yet another aspect of the invention, a method for diffusing a fluid includes receiving a fluid flow at an inlet, guiding the fluid flow into a first flow path having a radial turn from the inlet to a first collection chute, guiding the fluid flow into a second flow path having a turn in a direction perpendicular to the inlet from the inlet to the first collection chute, guiding the fluid flow into a third flow path having a radial turn from the inlet to a second collection chute, guiding the fluid flow into a fourth flow path having a turn in a direction perpendicular to the inlet from the inlet to the second collection chute, diffusing the fluid flow in the first collection chute, and diffusing the fluid flow in the second collection chute.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
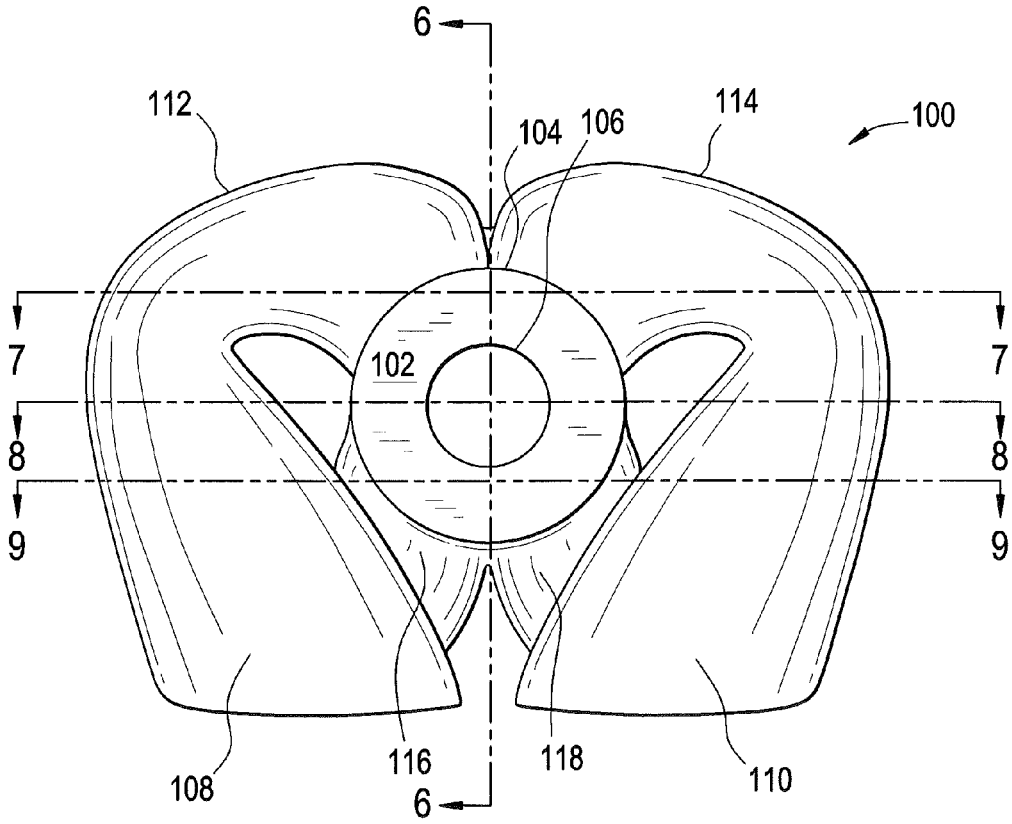
FIG. 1 illustrates a front view of an exemplary embodiment of an exhaust diffuser.
Figure 2:
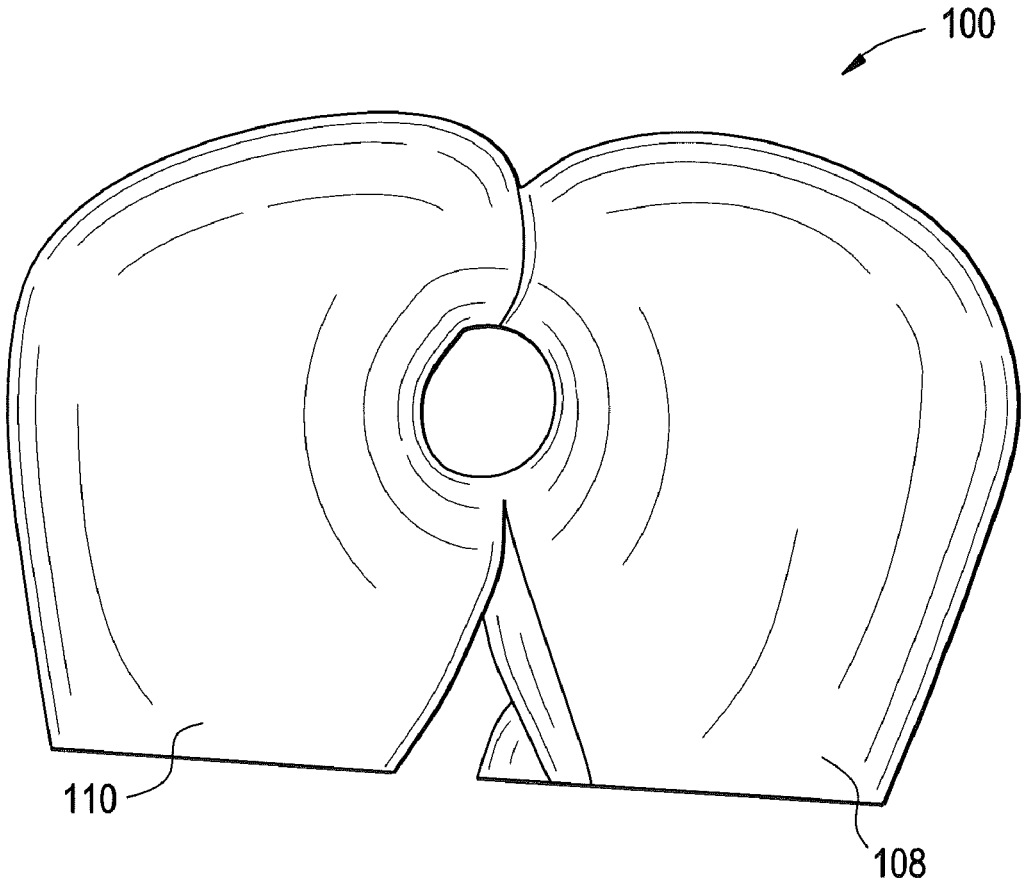
FIG. 2 illustrates a rear view of the diffuser of FIG. 1.
Figure 3:
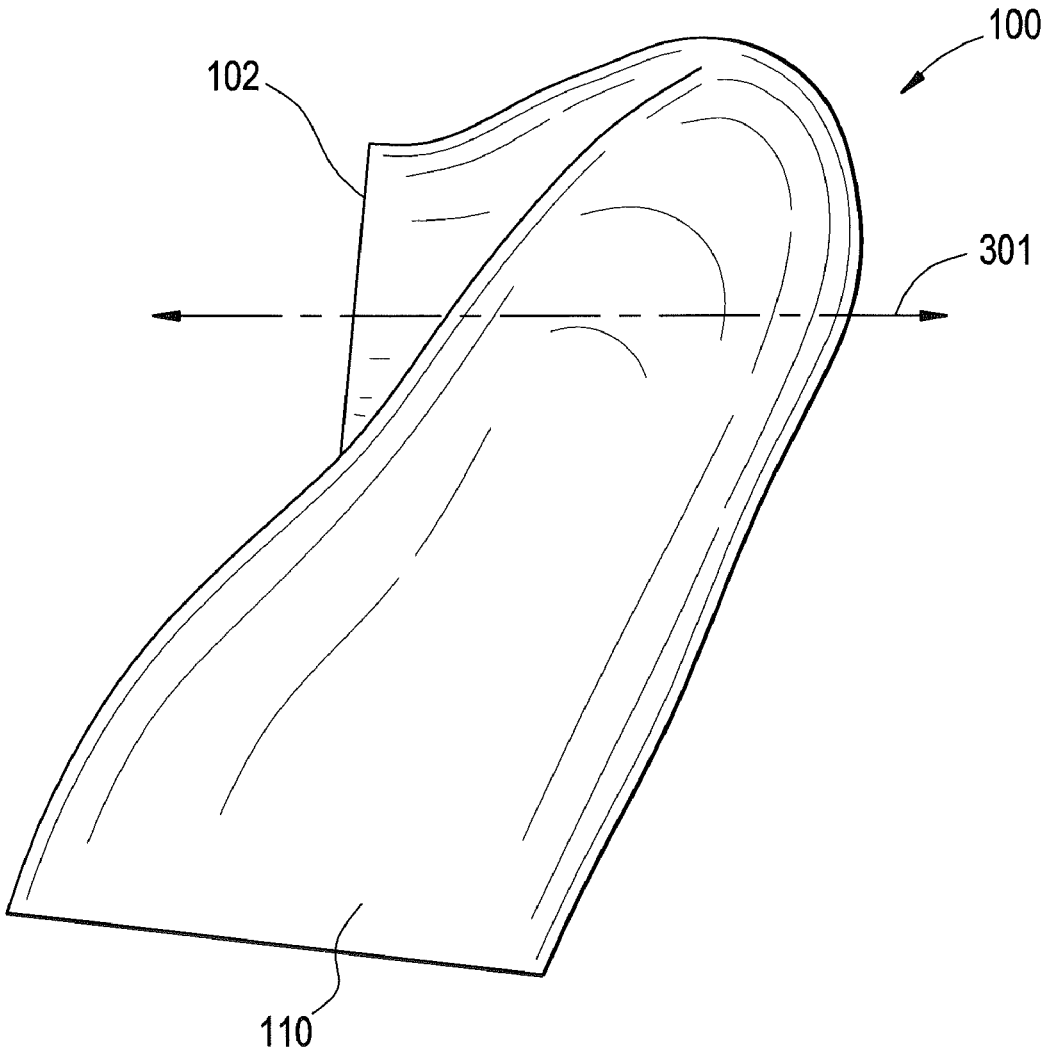
FIG. 3 illustrates a side view of the diffuser of FIG. 1.
Figure 4:
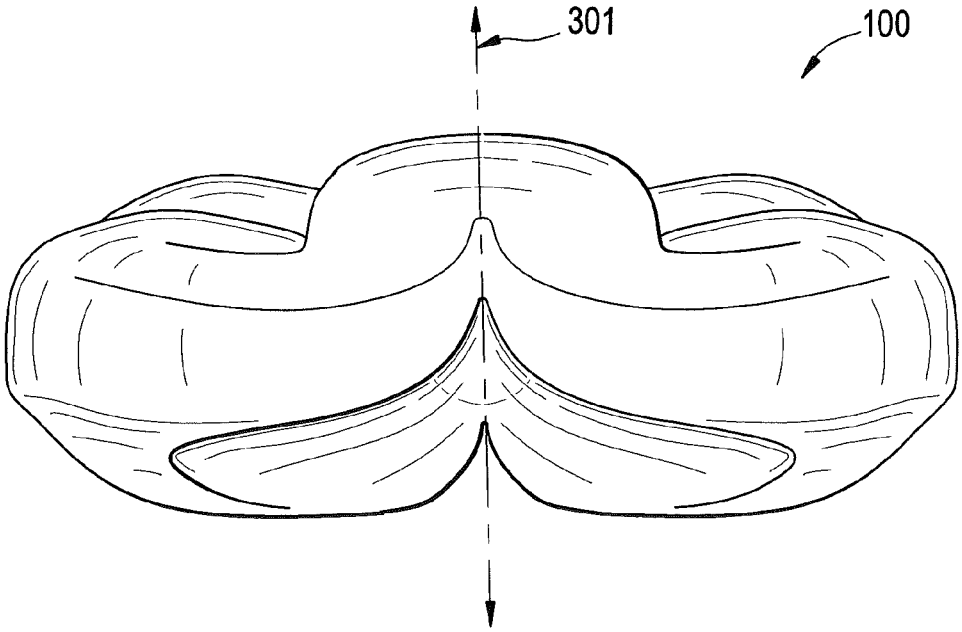
FIG. 4 illustrates a top view of the diffuser of FIG. 1.
Figure 5:
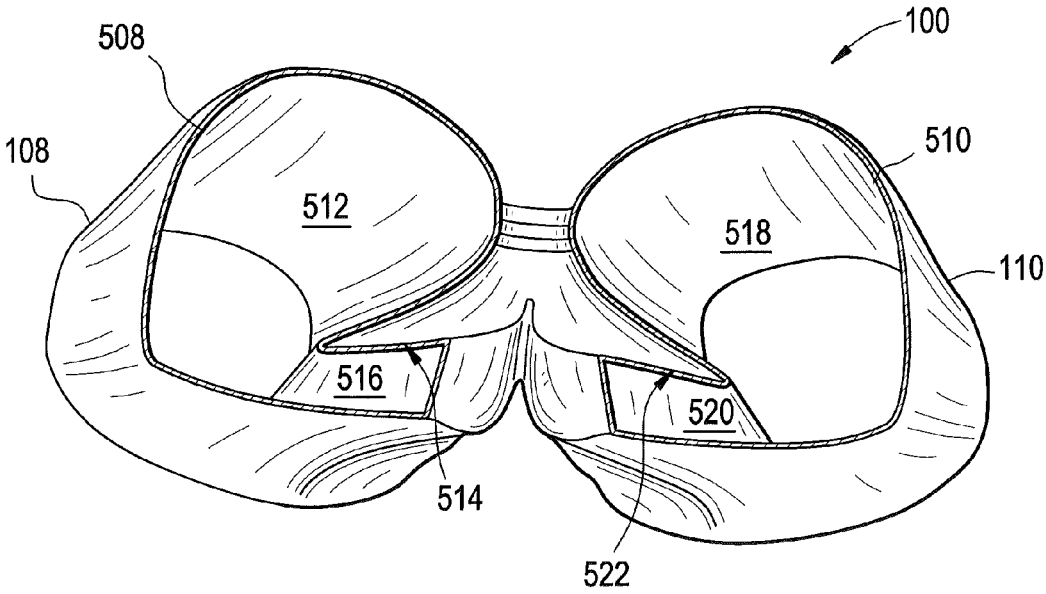
FIG. 5 illustrates a bottom view of the diffuser of FIG. 1.

FIG. 1 illustrates a front view of an exemplary embodiment of an exhaust diffuser (diffuser) 100. The diffuser 100 includes an annular inlet 102 having a planar area defined by an outer flow guide surface 104, an inner flow guide surface 106, a first collection chute 108 and a second collection chute 110, the collection chutes each having continuously increasing flow areas and are in fluid communication with the inlet 102 by radial turn portions 112 and 114 and right turn portions 116 and 118. FIG. 2 illustrates a rear view of the diffuser 100. FIG. 3 illustrates a side view of the diffuser 100 and an axis 301 of the inlet 102. FIG. 4 illustrates a top view of the diffuser 100. FIG. 5 illustrates a bottom view of the diffuser 100 including a first collection chute outlet 508 and a second collection chute outlet 510 that are defined by the outer flow guide surface 104 and the inner flow guide surface 106. The first collection chute outlet 508 includes a diffusion portion 512 and a region 516 that are partially defined by a wedge shaped baffle portion 514. The second collection chute includes a diffusion portion 518 and a region 520; partially defined by a wedge shaped baffle portion 522.

Figure 6:
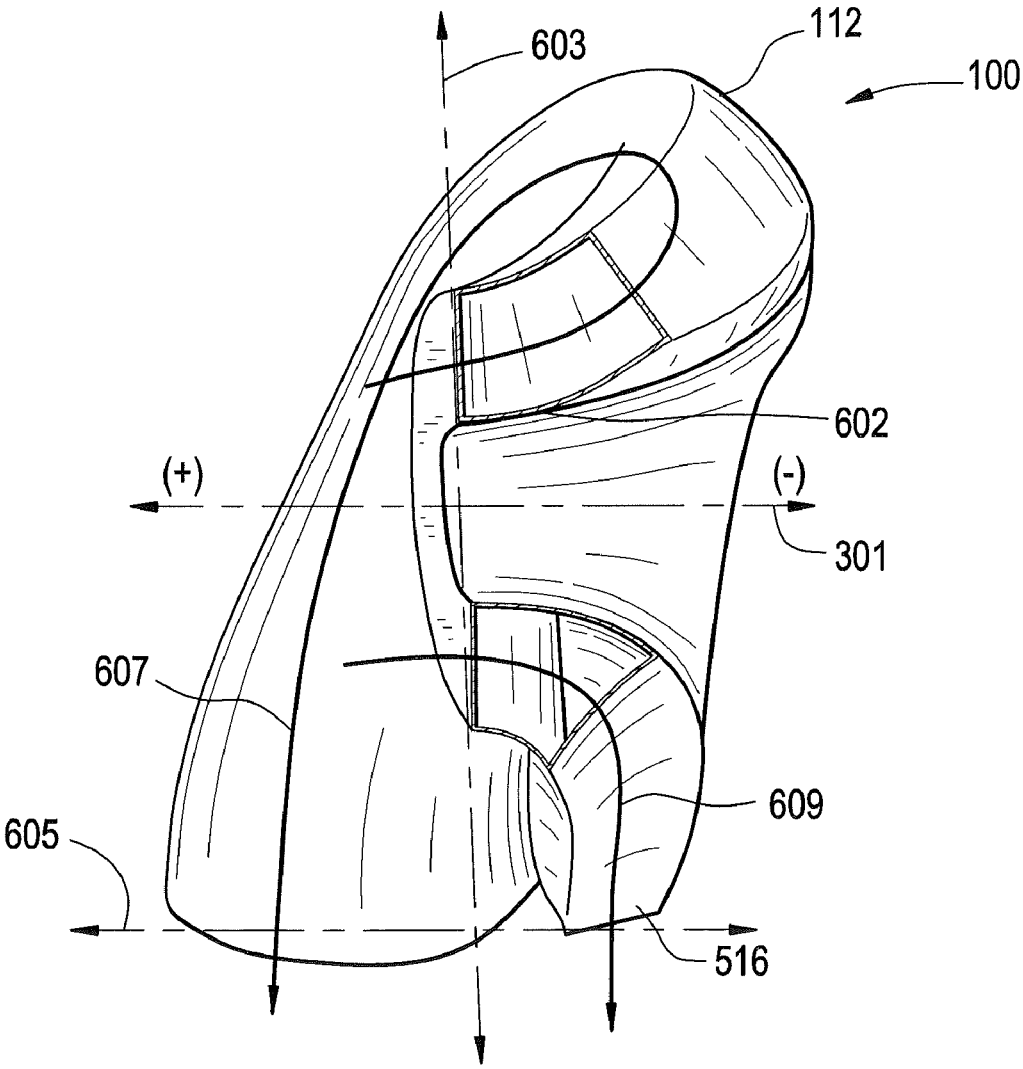
FIG. 6 illustrates a side cross-sectional view of the diffuser along the line 6-6 of FIG. 1.

FIG. 6 illustrates a side cross-sectional view of the diffuser 100 along the line 6-6 (of FIG. 1). In the illustrated exemplary embodiment the inner flow guide surface 106 includes a hyperboloid shaped portion 602 concentric to the axis 301 of the inlet 102. The inlet 102 defines a planar area illustrated by the line 603. A positive region and a negative region are defined by the planar area illustrated by the line 603. The first collection chute outlet 508 and the second collection chute outlet 510 define coplanar areas illustrated by the line 605. In operation, the diffuser 100 receives a fluid such as, for example, exhaust steam discharged axially from a steam turbine (not shown) at the inlet 102. The fluid is guided by the inner flow surface 106 and outer flow surface 104 into flow paths. The inner flow surface 106 may include a hyperboloid shaped, elliptical, or conical shaped portion 602. A first flow path is indicated by the arrow 607. The first flow path 607 flows radially from the inlet to the first collection chute 108. The fluid in the first flow path 607 maintains a low diffusion rate in the radial turn portion 112 of the diffuser 100 from the inlet 102 to the first collection chute 108. The first collection chute 108 has a continuously increasing flow area that diffuses the fluid. The fluid exits the first collection chute outlet 508 and enters, for example, a condenser (not shown). A second flow path is indicated by the arrow 609, and flows from the inlet 102 to the outer flow guide surface 104 that directs the second flow path 609 in a 90 degree curve to exit the diffuser 100 from the region 516. The diffuser 100 is symmetrical in shape, thus the opposing half of the diffuser 100 (not shown in FIG. 6) defines a third flow path similar, to the first flow path 607, that flows through the radial turn portion 114 to the second collection chute 110 (of FIG. 1) and exits the second collection chute outlet 510 (of FIG. 5); and a fourth flow path 909 (of FIG. 9) similar, to the second flow path 609 that exits the region portion 520 (of FIG. 5). The diffuser 100 guides the fluid into fifth and sixth flow paths, described in further detail below.

Figure 7:
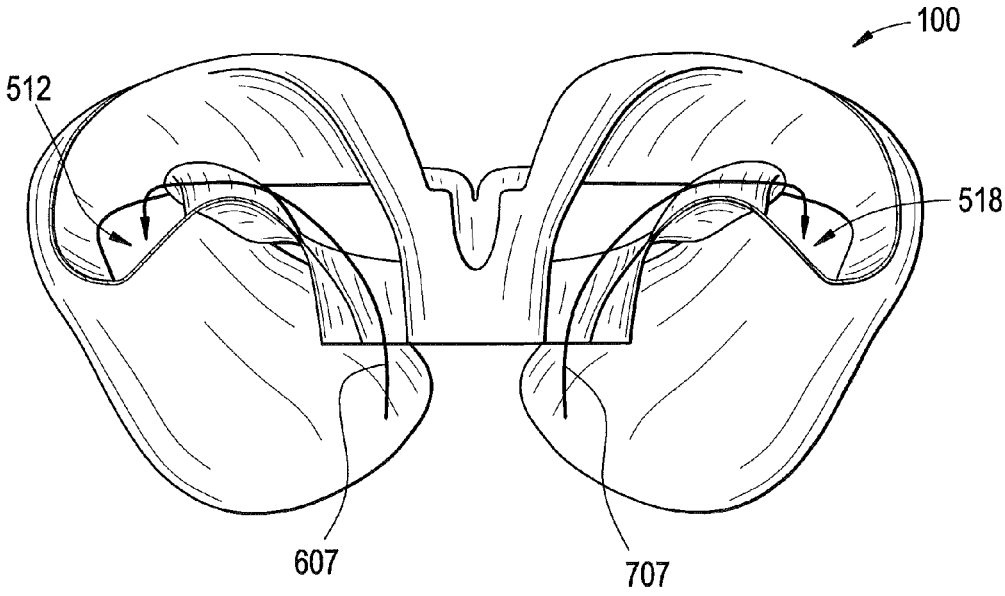
FIG. 7 illustrates a top cross-sectional view along the line 7-7 of FIG. 1.

FIG. 7 illustrates a top cross-sectional view along the line 7-7 (of FIG. 1) including the first flow path 607 and the third flow path indicated by the arrow 707.

Figure 8:
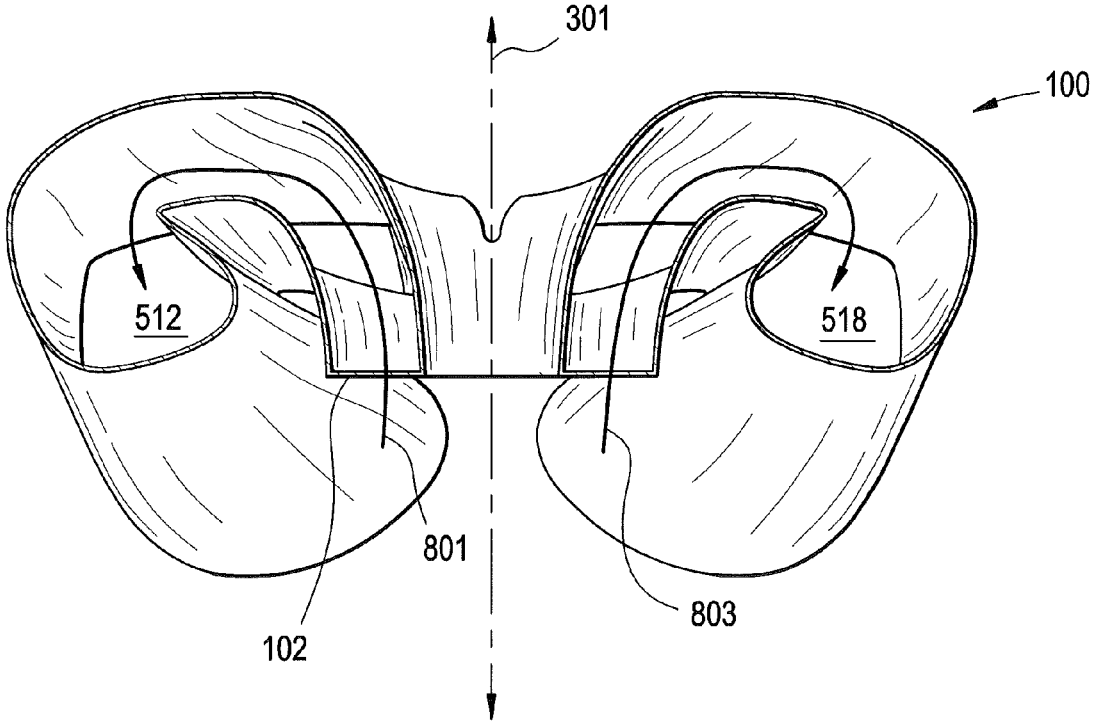
FIG. 8 illustrates a top cross-sectional view along the line 8-8 of FIG. 1.

FIG. 8 illustrates a top cross-sectional view along the line 8-8 (of FIG. 1). The illustrated embodiment includes a fifth flow path 801 and a similar sixth flow path 803. In operation, portions of the fluid entering the inlet 102 are guided into the flow paths 801 and 803, the flow paths 801 and 803 are directed by the inner flow guide surface 106 radially outward from the axis 301 and into the first and second collection chutes 108 and 110 where the fluid is diffused. The flow paths 801 and 803 exit the first and second collection chute outlets 512 and 518.

Figure 9:
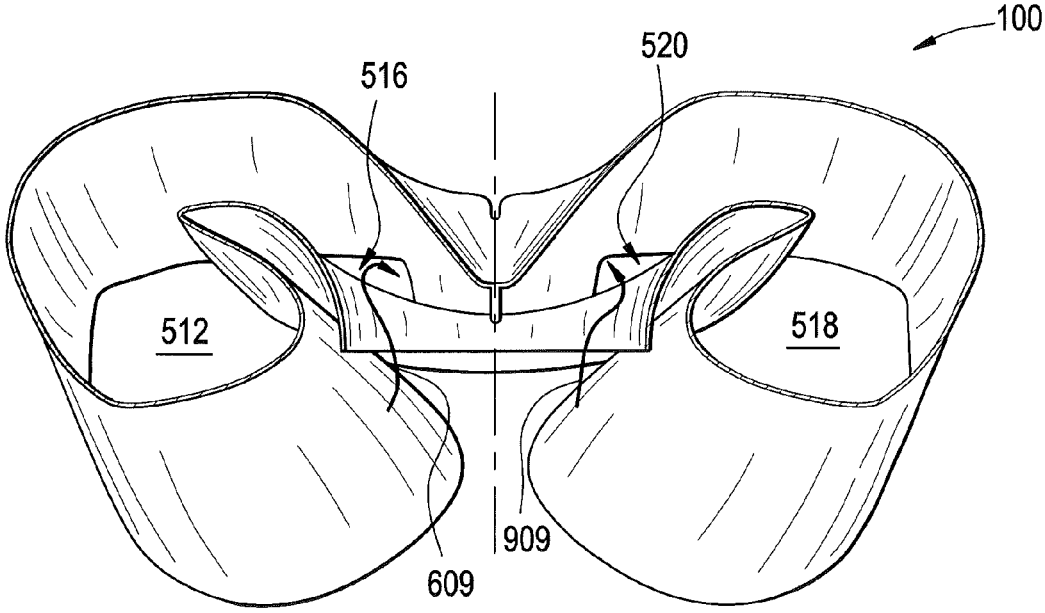
FIG. 9 illustrates a top cross-sectional view along the line 9-9 of FIG. 1.

FIG. 9 illustrates a top cross-sectional view along the line 9-9 (of FIG. 1). FIG. 9 further illustrates the second flow path 609 and the similar fourth flow path 909 (described above).

Figure 10:
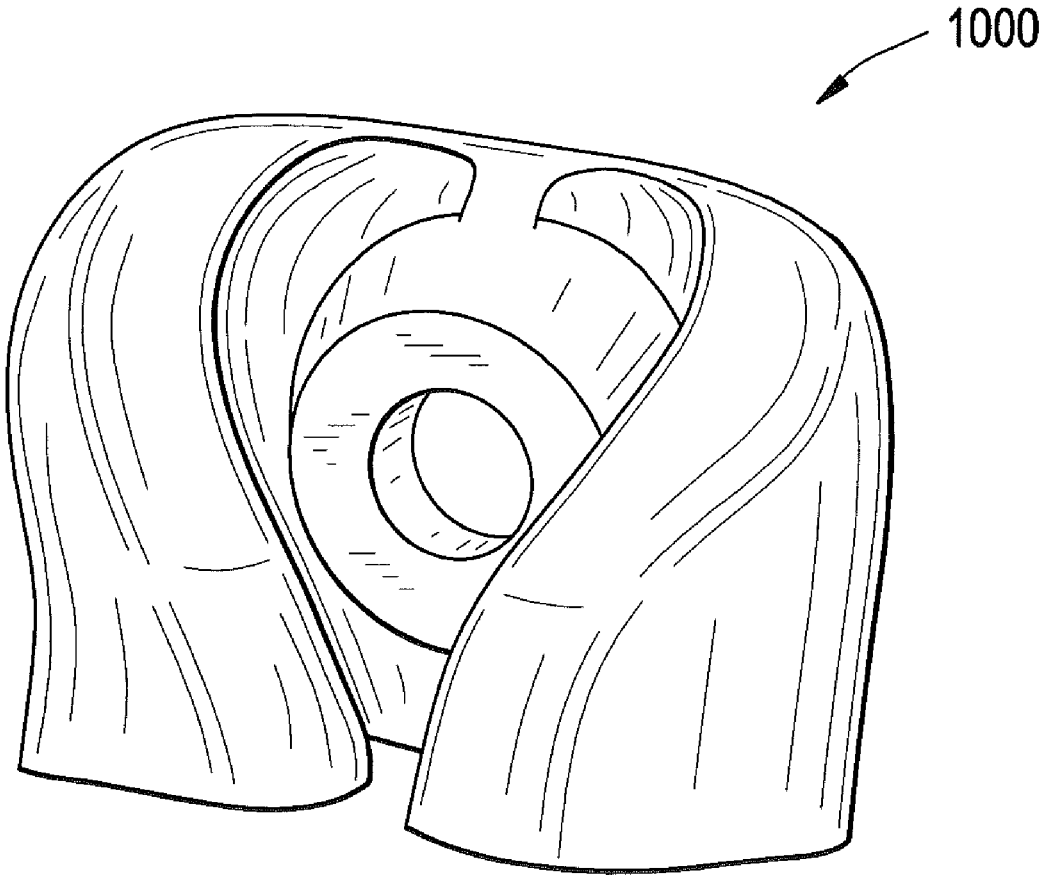
FIGS. 10-12 illustrate perspective views of alternate exemplary embodiment of a diffuser.
Figure 11:
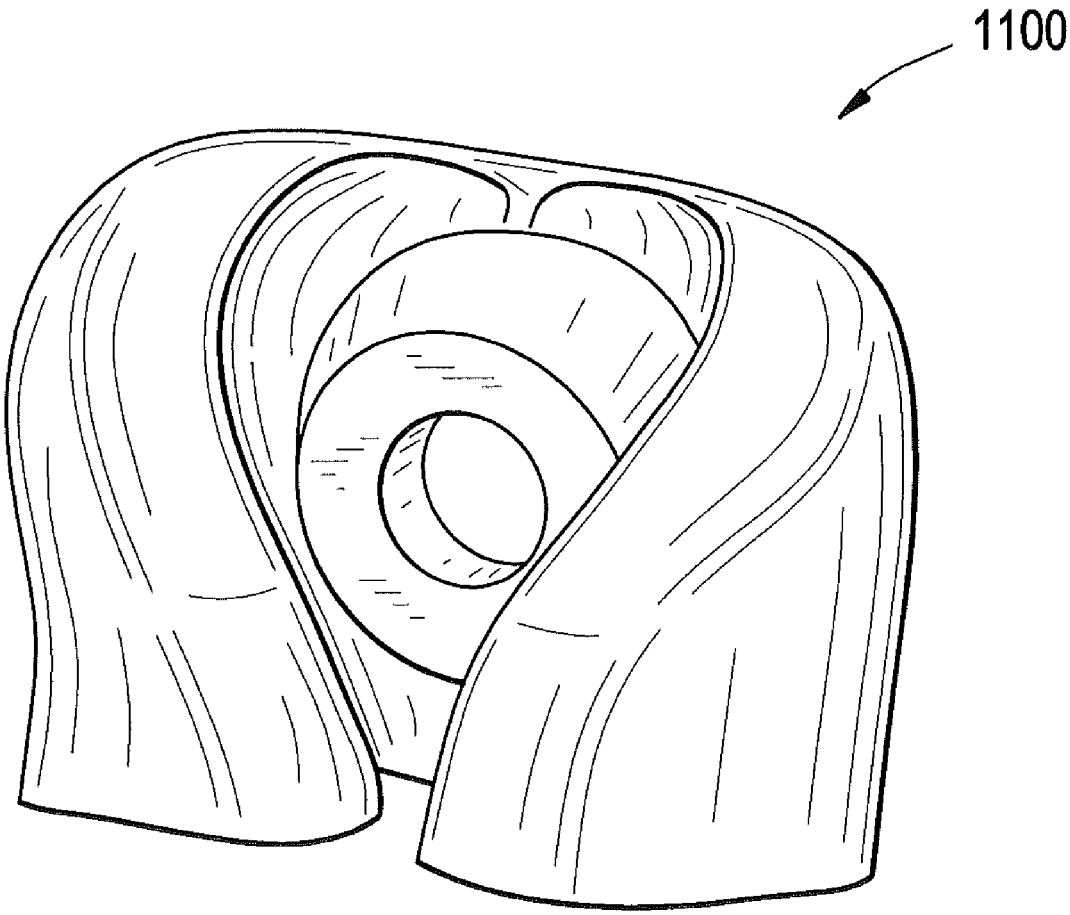
Figure 12:
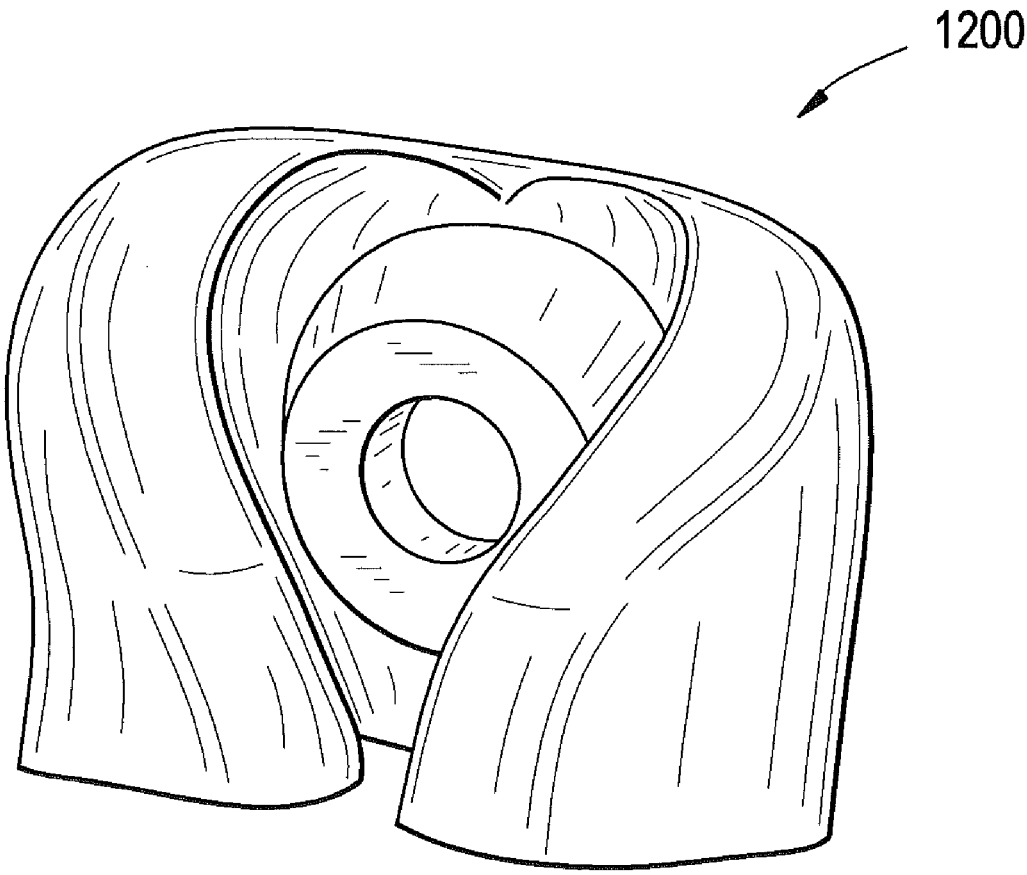

FIGS. 10-12 illustrate perspective views of alternate exemplary embodiments of diffusers 1000, 1100, and 1200 that operate similarly to the diffuser 100 described above however, are shaped to occupy less area when installed in a system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An exhaust diffuser comprising:

an inlet defined by an outer flow guide surface and an inner flow guide surface operative to receive a fluid, a center line passing vertically through a center of the inlet defining a horizontal center of the exhaust diffuser;

a first fluid flow structure including a first flow portion in communication with the inlet and configured to direct the flow of the fluid upward and horizontally outward from the inlet and then downward through a first collection chute to a first outlet, and a second flow portion in communication with the inlet and configured to direct the flow of the fluid downward and away from the center line to the first outlet, the first collection chute having an increasing flow area operative to diffuse the flow of a fluid; and a second fluid flow structure including a first flow portion in communication with the inlet and configured to direct the flow of the fluid upward and horizontally outward from the inlet and then downward through a second collection chute to a second outlet, and a second flow portion in communication with the inlet and configured to direct the flow of the fluid downward and away from the center line to the second outlet, the second collection chute having an increasing flow area operative to diffuse the flow of the fluid.

2. The exhaust diffuser of claim 1, wherein the inner flow guide surface includes a hyperboloid shaped portion at the inlet operative to guide the fluid into flow paths.

3. The exhaust diffuser of claim 1, wherein the first collection chute includes a first baffle portion that at least partially defines a first exit portion corresponding to the first flow portion of the first fluid flow structure and a second exit portion corresponding to the second flow portion of the first fluid flow structure; and the second collection chute includes a second baffle portion that at least partially defines a first exit portion corresponding to the first flow portion of the second fluid flow structure and a second exit portion corresponding to the second flow portion of the second fluid flow structure.

4. The exhaust diffuser of claim 1, wherein the annular inlet defines a first planar area, the first outlet defines a second planar area, and the second outlet defines a third planar area, and the first planar area is normal to the second planar area and the third planar area.

5. The exhaust diffuser of claim 4, wherein a space in front of the annular inlet from which fluid flows into the exhaust diffuser defines a positive region relative to the first planar area and a space behind the annular inlet defines a negative region relative to the first planar area, the outer flow guide surface and the inner flow guide surface define the first portion of the first fluid flow structure to follow a curved path terminating in a first portion of the first outlet located at least partially in the positive region relative to the first planar area, and the outer flow uide surface and the inner flow guide surface define the first portion of the second fluid flow structure to follow a curved path terminating in a first portion of the second outlet located at least partially in the positive region relative to the first planar area.

6. The exhaust diffuser of claim 5, wherein the outer flow guide surface and the inner flow guide surface define the second flow portion of the first fluid flow structure to follow a curved path terminating in a second portion of the first outlet located in the negative region relative to the first planar area, and the outer flow guide surface and the inner flow guide surface define the second flow portion of the second fluid flow structure to follow a curved path terminating in a second portion of the second outlet located in the negative region relative to the first planar area.

7. The exhaust diffuser of claim 4, wherein a space in front of the annular inlet from which fluid flows into the exhaust diffuser defines a positive region relative to the first planar area and a space behind the annular inlet defines a negative region relative to the first planar area, and the outer flow guide surface and the inner flow guide surface define the second portion of the first fluid flow structure to follow a curved path terminating in a portion of the first outlet located in the negative region relative to the first planar area; and the outer flow uide surface and the inner flow uide surface define the second portion of the second fluid flow structure to follow a curved path terminating in a portion of the second outlet located in the negative region relative to the first planar area.

8. The exhaust diffuser of claim 1, wherein the inlet is annular.

9. The exhaust diffuser of claim 1, wherein inner edges of the first and second outlets are located inward of outside edges of the inlet in a longitudinal direction.

10. The exhaust diffuser of claim 1, wherein an outer flow guide surface of each of the first outlet and the second outlet slopes toward the inlet from a rear of the exhaust diffuser to a front of the exhaust diffuser.

11. The exhaust diffuser of claim 1, wherein the second flow portions of the first and second collection chutes are configured to direct at least a portion of the fluid flow from the inlet into a fluid flow of the first flow portions of the first and second collection chutes at a location upstream of the first and second outlets.

12. An exhaust diffuser, comprising:

an inlet defined by an outer flow guide surface and an inner flow guide surface;

a first fluid flow structure defined by the outer and inner fluid flow guide surfaces to direct a fluid upward and away from the inlet and downward through a first collection chute to a first outlet, the first collection chute operative to diffuse a flow of a fluid; and a second fluid flow structure defined by the outer and inner fluid flow guide surfaces to direct a fluid upward and away from the inlet and downward through a second collection chute to a second outlet, the second collection chute operative to diffuse the flow of the fluid, wherein the inlet defines a first plane and the first plane defines a positive region corresponding to a region from which fluid flows into the inlet and a negative region corresponding to a region into which fluid flows from the inlet, at least a portion of the first and second outlets are located in the positive region, and the first fluid flow structure and the second fluid flow structure are configured to direct at least a portion of fluid that flows through the first and second collection chutes in a direction from the negative region to the positive region.

13. The exhaust diffuser of claim 12, wherein the inlet is annular.

14. The exhaust diffuser of claim 12, wherein the first fluid flow structure includes a radial turn portion between the inlet to the first collection chute, the flow having a higher diffusion rate in the first collection chute than in the radial turn portion.

15. The exhaust diffuser of claim 12, wherein the first fluid flow structure includes a 90 degree turn portion configured to turn a fluid flow 90 degrees from an axis of the inlet to the first collection chute, the flow having a higher diffusion rate in the first collection chute than in the 90 degree turn portion.

16. A method for diffusing a fluid, the method including:

receiving a fluid flow at an inlet, a center line passing vertically through a center of the inlet defining a horizontal center of an exhaust diffuser;

guiding the fluid flow into a first flow path having a radial turn upward and away from the inlet to a first collection chute;

guiding the fluid flow into a second flow path having a turn in a direction perpendicular to the inlet downward and outward from the center line of the inlet to the first collection chute;

guiding the fluid flow into a third flow path having a radial turn upward and away from the inlet to a second collection chute;

guiding the fluid flow into a fourth flow path having a turn in a direction perpendicular to the inlet downward and outward from the center line of the inlet to the second collection chute;

diffusing the fluid flow in the first collection chute; and diffusing the fluid flow in the second collection chute.

* * * * *